US008176665B2

(12) United States Patent
Petrovic

(10) Patent No.: US 8,176,665 B2
(45) Date of Patent: May 15, 2012

(54) PORTABLE TARGET STAND FOR SIGNAGE

(76) Inventor: Peter Petrovic, LaGrange Park, IL (US)

( * ) Notice: Subject to any disclaimer, the term of this patent is extended or adjusted under 35 U.S.C. 154(b) by 259 days.

(21) Appl. No.: 12/655,231

(22) Filed: Dec. 28, 2009

(65) Prior Publication Data

US 2011/0154703 A1 Jun. 30, 2011

(51) Int. Cl.
*G09F 15/00* (2006.01)

(52) U.S. Cl. ..... 40/607.1; 40/606.01

(58) Field of Classification Search ..... 40/607.1, 40/606.14, 607.01; 248/548, 127, 163.1, 248/158, 523
See application file for complete search history.

(56) References Cited

U.S. PATENT DOCUMENTS 3,762,674 A * 10/1973 Ortega ..... 248/346.04
3,924,344 A * 12/1975 Davis ..... 40/592
4,368,586 A * 1/1983 Forzelias ..... 40/604
4,642,946 A * 2/1987 Koch ..... 52/38
4,969,618 A * 11/1990 Thompson ..... 248/152
5,402,988 A * 4/1995 Eisele ..... 256/24
5,836,714 A * 11/1998 Christensen ..... 404/6
6,668,474 B2 * 12/2003 Winterton et al. ..... 40/610
7,644,896 B1 * 1/2010 Niner ..... 248/159
2005/0211862 A1 * 9/2005 Autenrieth ..... 248/431

* cited by examiner

*Primary Examiner* — Joanne Silbermann
*Assistant Examiner* — Kristina Junge
(74) *Attorney, Agent, or Firm* — Basil E. Demeur; Alan B. Samlan; David J. Hurley

(57) ABSTRACT

There is disclosed an improved portable stand especially adapted for mounting targets for a shooting range, which consists of a base unit formed by a first leg and a second leg rotationally mounted to the first leg. The first leg is provided with a pair of spaced apart mounting apertures, each of the mounting apertures provided with lock means incorporated therein. At least two vertical arms are adapted to be mounted into each of the mounting apertures and lockingly engaged therein, and the vertical arms are adapted to hold and display a target therebetween.

12 Claims, 6 Drawing Sheets

PORTABLE TARGET STAND FOR SIGNAGE

I. FIELD OF THE INVENTION

The present invention relates to an easily erectable portable stand suitable for providing a stand for positioning on an underlying support service such as the ground, and supporting signage, targets or other suitable forms of indicia. The stand of the present invention is portable, and erects very easily, adaptable for various sizes of signage, targets or the like, and also permits multiple units to be interconnected thereby to expand to the width of the stand.

II. BACKGROUND OF THE INVENTION

In the past, various types of portable stands which are collapsible, or otherwise portable have been created and utilized. The patented art shows various types of such stands. For example, U.S. Pat. No. 2,706,609 shows a pedestal type supporting stand which has a tubular arrangement at the bottom end, with one tube telescopically fitted within the outer tube, thereby permitting the legs to fold together by rotating two of the legs relative to the other two. FIG. 2 illustrates the collapsed closed position of the stand. Similarly, U.S. Pat. No. 4,288,042 shows another form of a base for a free standing merchandiser wherein the legs are rotatable with respect to one another in order to present a flat configuration when the stand is closed for portability.

Still other versions of stands for various applications are illustrated. U.S. Pat. No. 2,606,522 illustrates a base intended for a bird bath and feeding table wherein the base is provided by having a fixed leg, to which a second leg is attached and rotates to the open position as illustrated in FIG. 2 such that, the second leg is positioned 90° relative to the first leg in order to form a support base. FIG. 4 illustrates the closed position of the base where the second leg is folded by rotating the same relative to the fixed leg, in order to achieve the portability making it more manageable. U.S. Pat. No. 4,763,866 again relates to a stand which is a free standing base, wherein the legs are foldable against one another for portability. Similar comments are applicable with respect to U.S. Pat. No. 5,022,620 wherein the legs may be interconnected and attached for supporting a member, but may be disconnected and removed from one another for portability purposes. It is clear that in order to utilize a stand of the construction as shown in the subject patent, a great deal of work must be expended, in order to connect and fit the legs together and disassemble the same for portability. While the present invention is directed to a portable base and stand for supporting a variety of signage or printed indicia, the stand of the present invention has particular applicability to providing a portable stand for a target utilized at a shooting range. Stands for that purpose have certain required features that will make them useful. For example, patent publication 2004/0036223 illustrates a stand for supporting targets which includes a base, an upright member, and a frame for supporting the target. As indicated therein, the base is secured by means of a pair of chambers which may be filled with sand, fluid such as water or the like, to render the base secure, then the base supports an upright member which is held in position by a screw or bolt. The upright then includes a frame which in turn holds the targets for the shooter. The aforesaid publication also references much of the prior art with respect to stands for target shooting, and explains quite aptly the difficulties encountered with construction according to each of the prior art patents. All of such prior art is incorporated herein by reference.

Again, one of the difficulties associated with presently available stands is that they are not particularly portable, and do require a considerable amount of effort in order to erect the same once the user reaches his desired location. Furthermore, most stands do not present adaptability in terms of the size of targets to be mounted on the support member. It is well known to persons involved in target shooting, different size targets are employed in order to perfect the shooters skills. Hence, a target shooter will advance from a larger target to a smaller target once his skills are improved.

The present invention is intended to provide a stand which is easily constructed, and once constructed, provides ease of portability, ease of erection for use, and provide adaptability for different size targets. Furthermore, the stand of the present invention may be employed in the format of multiple units which may be easily interconnected, thereby to greatly expand the usability of the present invention. In other words, one could employ multiple base units, and interconnect the same to expand the width of the entire target stand, and employ multiple targets thereon.

III. OBJECTS AND ADVANTAGES

It is therefore the principal object of the present invention to provide an improved portable stand of the type intended to carry and hold signage thereon, especially targets for target shooting, which is easily portable, easily erectable and is adaptable for different sized targets.

In conjunction with the foregoing object, it is a further object to provide an improved portable stand which is formed by a base unit consisting of a first leg and a second leg rotationally mounted to the first leg at the approximate mid point thereof, the second leg being rotationally movable relative to the first leg into a support position. The first leg is provided with at least two spaced apart mounting apertures formed therein, and each mounting aperture provided with lock means incorporated therein. At least two vertical arms are adapted to be mounted into each of the mounted apertures and lockingly engaged therein, the vertical arms are then adapted to carry the signage there between.

In connection with the foregoing object, and further a object of the invention is to provide a stand wherein the base includes multiple mounting apertures positioned along the length of the leg, such that the vertical arms may be positioned in any desired pair of mounting apertures such that the spacing between the two vertical arms may be varied according to the target desired by the user.

A further object of the present invention is to provide a stand of the type described above, wherein each of the mounting apertures is provided with a simplified locking system for locking and engaging the vertical arm to the base. The lock means eliminates any moving parts, and may be ideally constructed of materials which eliminate the possibility of deterioration from moisture or other weather conditions.

A further object of the present invention is to provide a stand for targets or the like, wherein the base unit is so constructed as to permit a plurality of bases to be interconnected within a lineal configuration, such that the overall width of the entire stand unit will be enlarged in order to accommodate large signage or targets, or multiple targets positioned on the same stand.

A further object of the present invention is to provide a portable stand in accordance with the invention, which also incorporates a securment means for securing the base of the stand to the underlying support surface especially where the underlying support surface is aground.

The above objects and further objects and advantages of the present invention will be understood by our reference to the accompanying specification and the further description.

IV. SUMMARY OF THE INVENTION

In accordance of the present invention, an improved portable stand particularly intended for target shooting is provided. The improved portable stand is formed by a base unit wherein the base is formed by a first leg and a second leg which is rotationally mounted to the first leg at the approximate mid point thereof. The second leg has a forward section and a rearward section, and is rotated relative to the first leg to erect the same, such that the forward section that is rotated to the rearward of the first leg, and the rearward section of the second leg is positioned forward of the first leg thereby to provide a base having the two legs being perpendicular one another. The first leg is provided with at least two spaced apart mounting apertures which are formed therein, each of the mounting apertures having lock means incorporated therein. At least two vertical arms are provided and are adapted to be mounted into each of the mounting apertures and lockingly engaged therein. The vertical arms are intended to carry a target or any signage therebetween.

A further improvement associated with the present invention is the construction of the first and second legs relative to one another. The first leg is constructed with a width dimension approximately double the width of the second leg, the first leg includes a pair of insets positioned diagonally opposed to each other, one inset being forward of the midpoint, and the other inset being rearward of the midpoint. Each of the insets has a width approximately equal to the width of the second leg such that when the second leg is rotationally moved to a closed position, the forward section thereof nests within the rearward inset, and the rearward section nests within the forward inset. In this manner, once the base unit is folded to the closed position, it presents a very compact arrangement.

The present invention is further constructed such that the first leg may be provided with a plurality of mounting apertures spaced along the length of the first leg, each of the mounting apertures provided with lock means incorporated therein. In this manner, the vertical arms may be mounted to any of the mounting apertures along the length of the first leg, such that the spacing between the opposed vertical arms may be varied and therefore accommodate a variety of different sized targets therebetween.

The present invention is a further improvement over the prior art structures in that the lock means which are incorporated in each of the mounting apertures are constructed of non-moving parts. The lock means consist of an inner wall formed in the mounting aperture and an outer wall formed therein. A lock plate is positioned forward of the inner wall, and includes spring means interposed between the inner wall and the lock plate whereby the vertical arm which is mounted in the mounting aperture is mounted by pressing the arm into the mounting aperture and allowing the arm to be captured between the lock plate and the outer vertical wall. The spring means consist of a foam material mounted to the inner wall along one surface, and is mounted to the lock plate at its opposed surface, the foam material consisting of a compressible foam material such as rubber or the like. As a further improvement, the lock plate may have a convex or a frusto conical surface such that when the mounting arm is pressed into the mounting aperture, the convex surface permits the mounting arm to easily slide into a locked position.

A further improvement associated with the present invention is the fact that a plurality of base units may be interconnected one to the other in a lineal arrangement, such that the target stand may be expanded width-wise to accommodate any number of targets, or any sized target desired. Interconnection occurs by employing multiple base units stacked upon one another, and interconnected by means of the mounting arms which are slid through aligned mounting aperture formed in the first leg of each of the base units.

The above features will be better understood by referencing the accompanying drawings and specification.

V. BRIEF DESCRIPTION OF DRAWINGS

VI. DETAILED DESCRIPTION OF DRAWINGS

Figure 1:
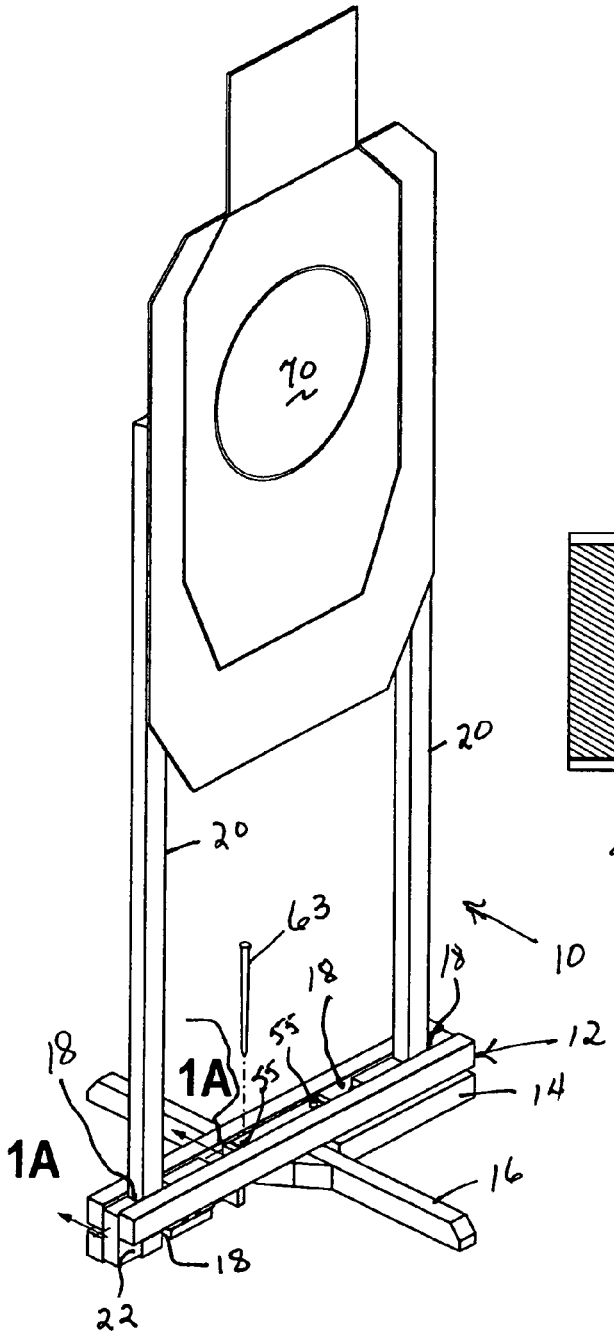
FIG. 1 is a perspective view showing the base fully erected, and the vertical arms inserted into the mounting apertures, and supporting a target thereon.
Figure 1A:
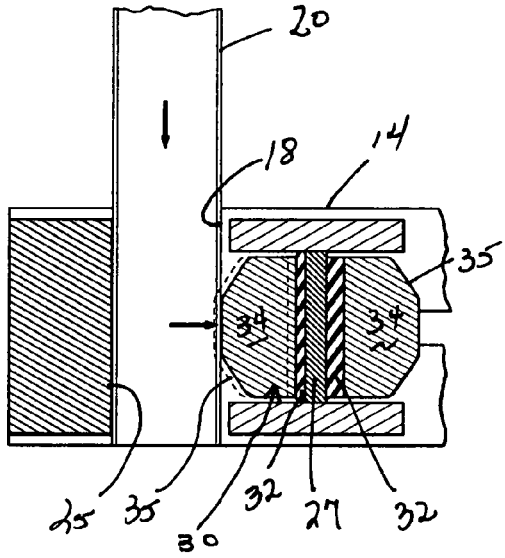
FIG. 1A is a cross sectional view taken in the direction of the arrows along the line 1A-1A of FIG. 1.

With reference to FIGS. 1 and 1A of the drawings, the stand generally referred to by the numeral 10 is illustrated. The stand 10 is shown to be formed by a base unit 12, which consists of a first leg 14, and a second leg 16. The second leg 16 is shown to be pivotally mounted to the first leg 14, by means of a pivot pin as will be more fully illustrated in FIGS. 6 and 9 of the drawings. As illustrated in FIG. 1, the base unit 12 is shown in its fully erected and open position with the second leg 16 being pivotally moved to a support position relative to the first leg 14, such that the legs 14 and 16 respectively form cross members. It will also be observed in FIG. 1, that the first leg 14 includes a rearward inset 22 and a diagonally opposed forward inset 24. (FIG. 9)

Figure 2:
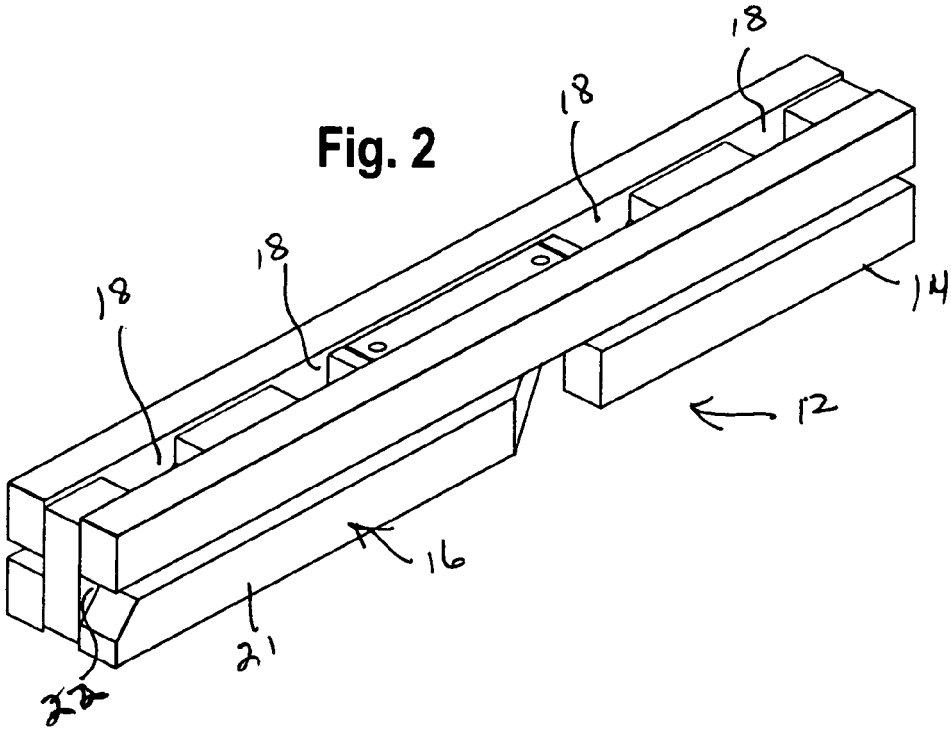
FIG. 2 is a perspective view showing the base unit in its folded and closed position with the second leg nested within the insets of the first leg.
Figure 3:
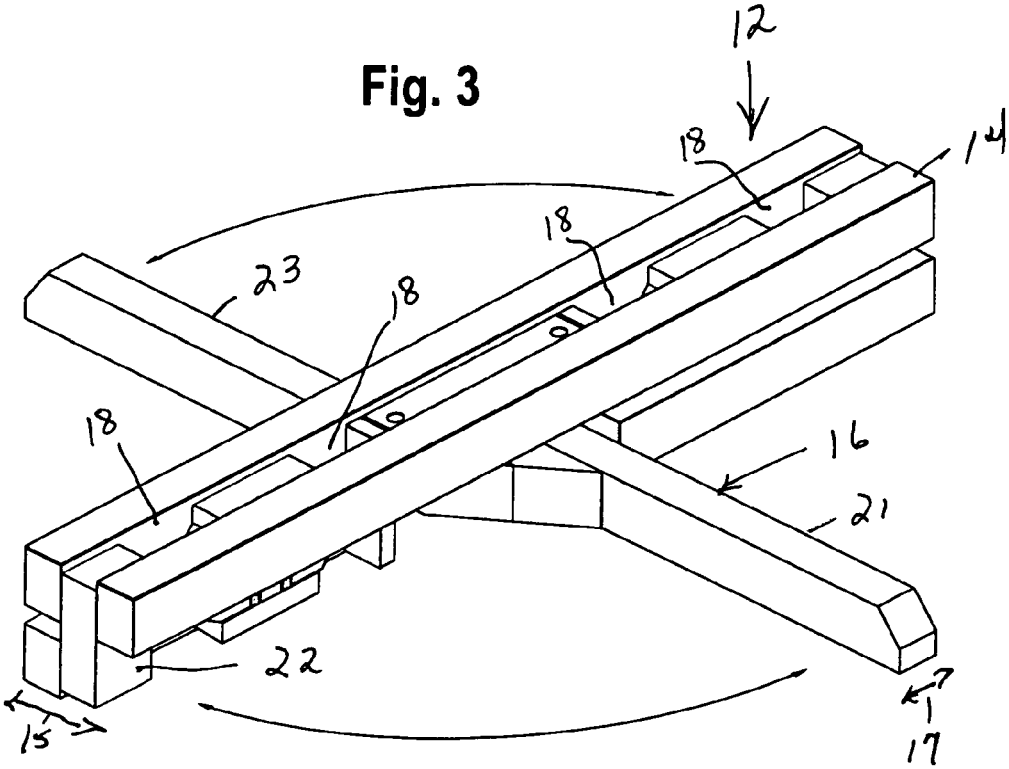
FIG. 3 illustrate the second leg rotationally moved to its open position relative to the first leg forming cross members forming the support base.
Figure 4:
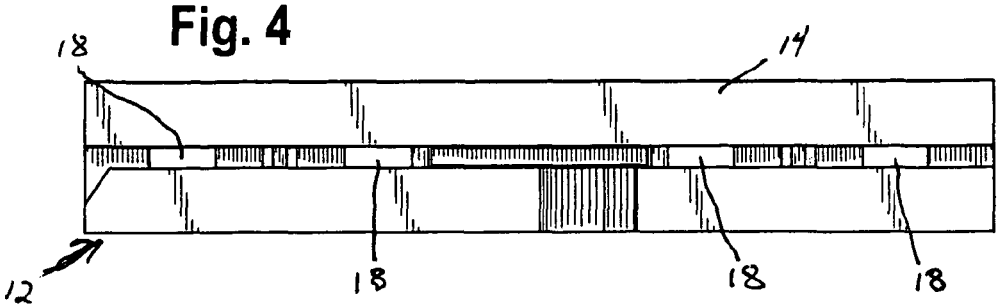
FIG. 4 is a side view of the first leg showing a series of four mounting apertures spaced along the length of the leg.
Figure 5:
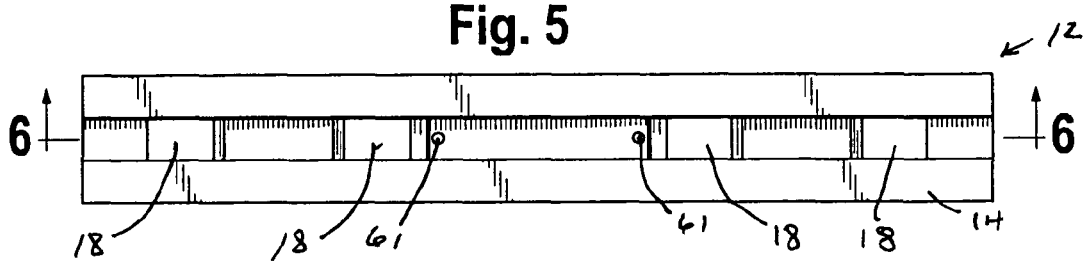
FIG. 5 is a top view of the first leg showing a series of four mounting apertures spaced along the length of the first leg.

As illustrated in FIGS. 2 and 3 of the drawings, the first leg 14 has a width 15 which is slightly greater than the width 17 of the second leg 16. As indicated previously, the first leg 14 includes a forward inset 22, and rearward inset 24. The second leg 16 is formed by a forward section 21, and a rearward section 23. As illustrated in FIGS. 2 and 3 of the drawings, and with particular reference to FIG. 2, when the second leg 16 is rotated to its closed position, the forward section 21 of leg 16 will nest within the rearward inset 22 of the first leg 14 while the rearward section 23 of the second leg 16 will nest within the forward section 21 of the first leg 14. The closed position is illustrated in FIG. 2 while the open position is illustrated in FIG. 3.

As further illustrated in FIGS. 2 and 3 of the drawings, the first leg 14 may be provided with a plurality of mounting apertures 18, and as shown in these figures, a series of four mounting apertures 18 are illustrated. It would be apparent to anyone skilled in the art. that the length of the first leg 14 may be made to accommodate any number of mounting apertures 18, and it will be appreciated from the following description that for ease of portability and weight, it has been determined that four mounting apertures 18 formed in the first leg 14 are adequate since the base unit 12, may be connected with a series of other base units 12 to provide an expanded stand arrangement.

Figure 6:
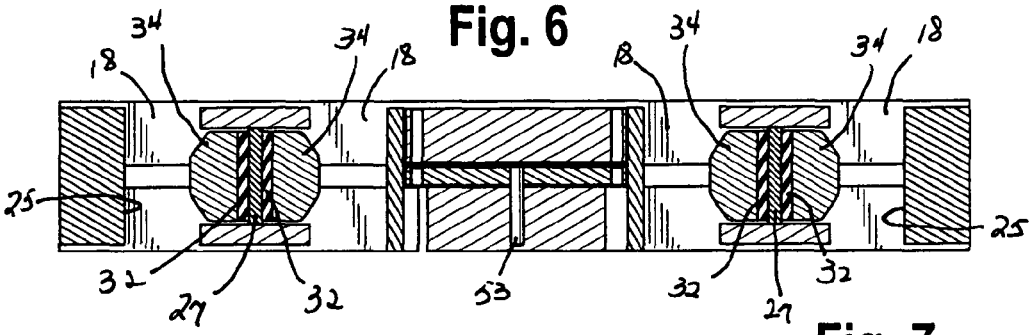
FIG. 6 is a cross-sectional view taken along the line 6-6 of FIG. 5, and shows the mounting apertures having the lock means installed within each mounting aperture of the first leg.
Figure 7:
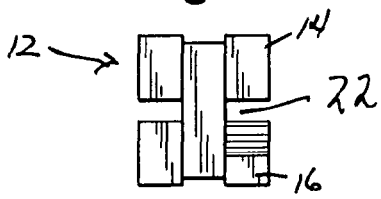
FIG. 7 is an end view of the base showing the first leg with one of the insets and having the second leg nested within the inset when in the closed position.
Figure 8:
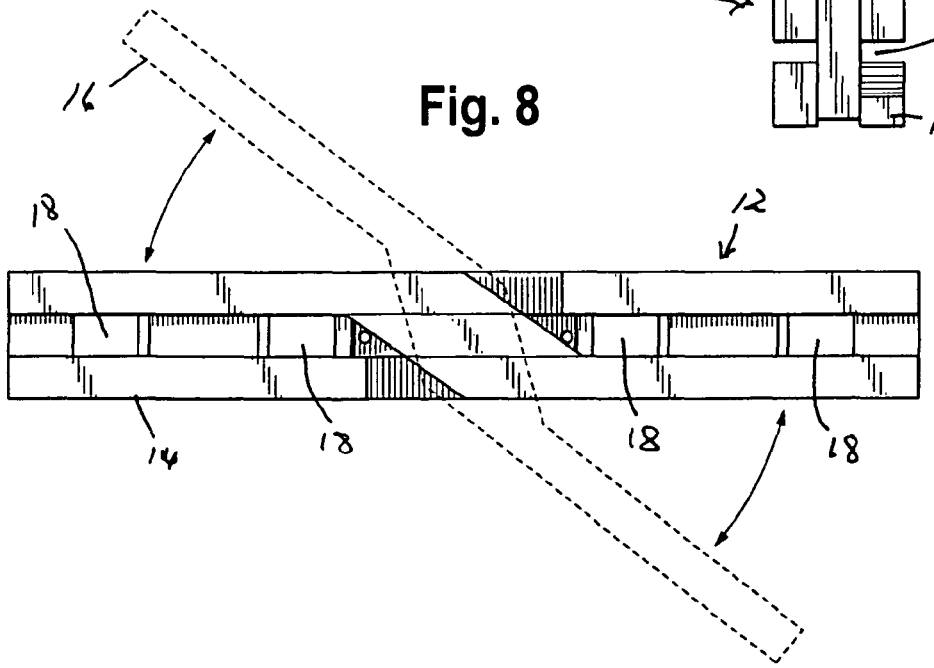
FIG. 8 is a top view showing the first leg, and the second leg in phantom, and being rotationally movable between the closed and open position.
Figure 9:
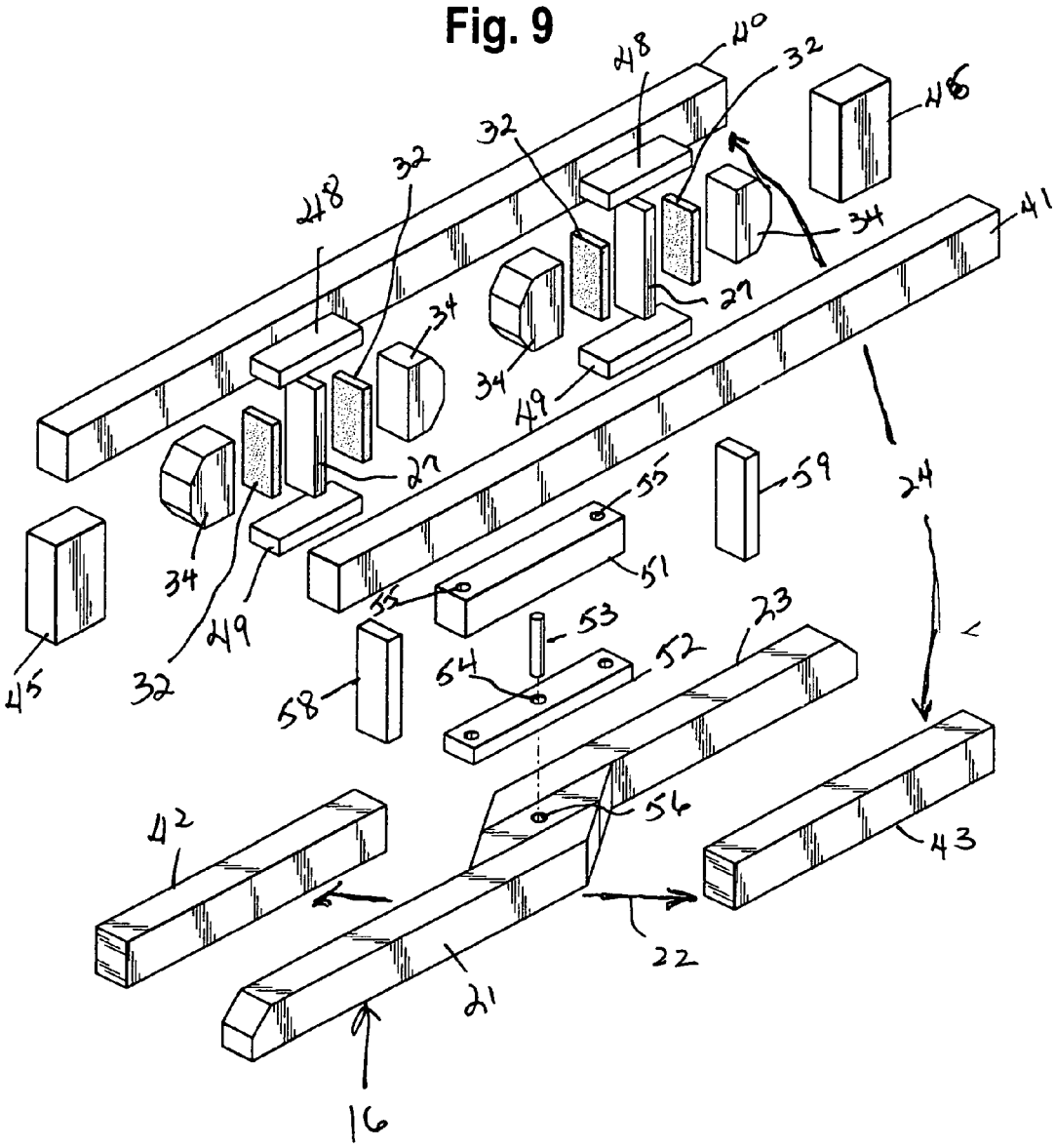
FIG. 9 is an exploded view showing the construction of all of the various parts and elements forming the first leg and second leg, the mounting apertures and the lock means associated and incorporated within the mounting apertures.

As shown in FIGS. 1A, 6, and 9, the details of the lock means 30 is illustrated. Each of the mounting apertures 18 is formed by means of an outer vertical wall 25, and an inner vertical wall 27. A compressible pad 32 is mounted to the inner vertical wall 18, such as by adhesive or other securment means. Lock means also include a lock plate 34 which is mounted to the opposed surface of the compressible pad 32. The lock plate 34 is sized such that it slightly constricts the width of the mounting aperture 18 when in its rest position. FIG. 1A illustrates the compressible pad 32 with a compressed posture once the vertical arm 20 is inserted into the mounting aperture 18. The compressible pad 32 is formed with of a foam material which has a memory such that the material will always return to its rest position. Such materials may include rubber, or other foam material that is slightly compressible, but have a memory to return to their uncompressed position once the pressure is removed.

FIG. 1A as well as FIG. 6 illustrates that the lock plate 34 may be provided with a convex or frusto-conical surface illustrated by the numeral 35 thereby rendering the insertion of the vertical arm 20 into the mounting aperture 18 it a relatively easy operation.

From a view of FIG. 6 of the drawings, base unit 12 of the present invention, may he constructed with a series of four mounting apertures 18 which are spaced such that lock means 30 may be installed on either side of each inner vertical wall 29. Each of the lock means 30 is constructed in the identical manner consisting of the compressible pad 32 being secured to the inner wall and the lock plate 34 being mounted to the opposed surface of the compressible pad 32. Hence, the mounting aperture 18 is actually formed as between the outer vertical wall 25, and the front surface of lock plate 34. The vertical arm 20 includes a width dimension which will slide into the mounting aperture 34 applying slight pressure to the lock plate 34, thereby compressing the compressible pad 32 thereby lockingly engaging the vertical arm 20 in the mounting aperture 18.

As shown in FIG. 1, a pair of vertical arms 20 are mounted into opposed mounting apertures 18 which are located at opposed ends of the base 12. This permits a larger distance between the vertical arms 20 in order to accommodate a target 70 of a larger size. Alternatively, the mounting arms 20 may be inserted into the inner mounting apertures 18 such that the distance between the two vertical arms would be shorter, and accommodate a smaller target.

Figure 10:
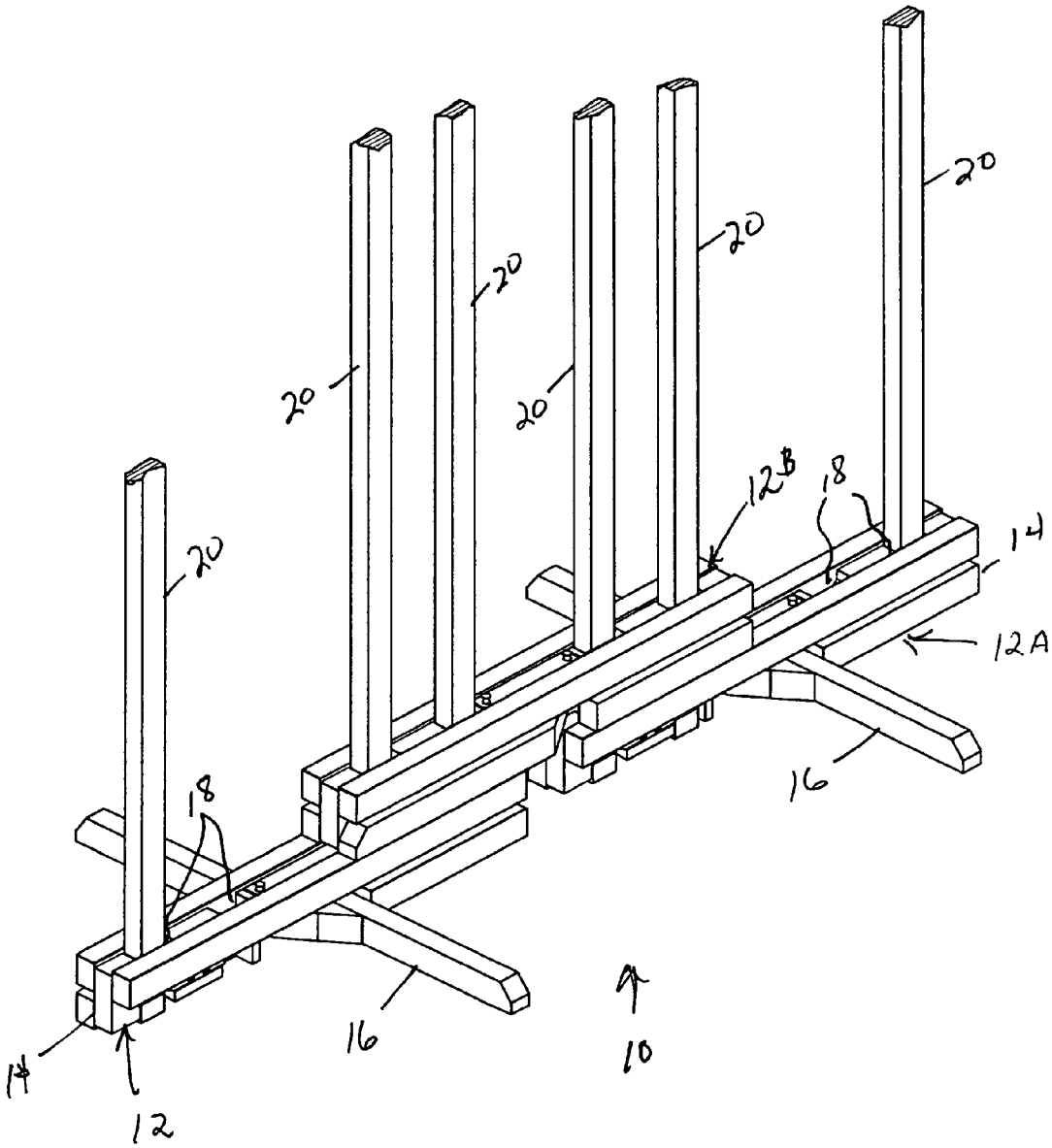
FIG. 10 is a perspective view showing a series of three base leg units interconnected by means of mounting arms which are inserted through the mounting apertures of multiple base units thereby to expand the lineal length of the target stands.

As illustrated in FIG. 10 of the drawings, the size of the entire stand unit 10 may be greatly expanded by using a plurality of base units 12. As illustrated in FIG. 10, a series of 3 base units are employed, consisting of base unit 12, 12*a* and 12*b*. For ease of reference the same numerals are utilized for the parts of each of the base unit components. As shown, base unit 12 and 12*a* are interconnected by employing a third base unit 12*b*, which is stacked on top of base units 12 and 12*a*. They are interconnected by the use of plurality of vertical arms 20 which are slid through the mounting apertures 18 of the respective base units 12, 12*a* and 12*b*. This is accomplished by aligning base unit 12*b* on top of base units 12 and 12*a* such that the mounting apertures are in vertical alignment. The vertical arms 20 may then be inserted through the mounting apertures to be lockingly engaged as between the respective mounting apertures of base unit 12*b* as well as 12 and 12*a*. Each of the second legs 16 of base unit 12 and 12*a* are then rotated to the open position as illustrated in FIG. 10, and it would be appreciated that the entire stand 12 has now been expanded horizontally such that either larger targets, or multiple targets may be installed onto the vertical arms 20.

Figure 11:
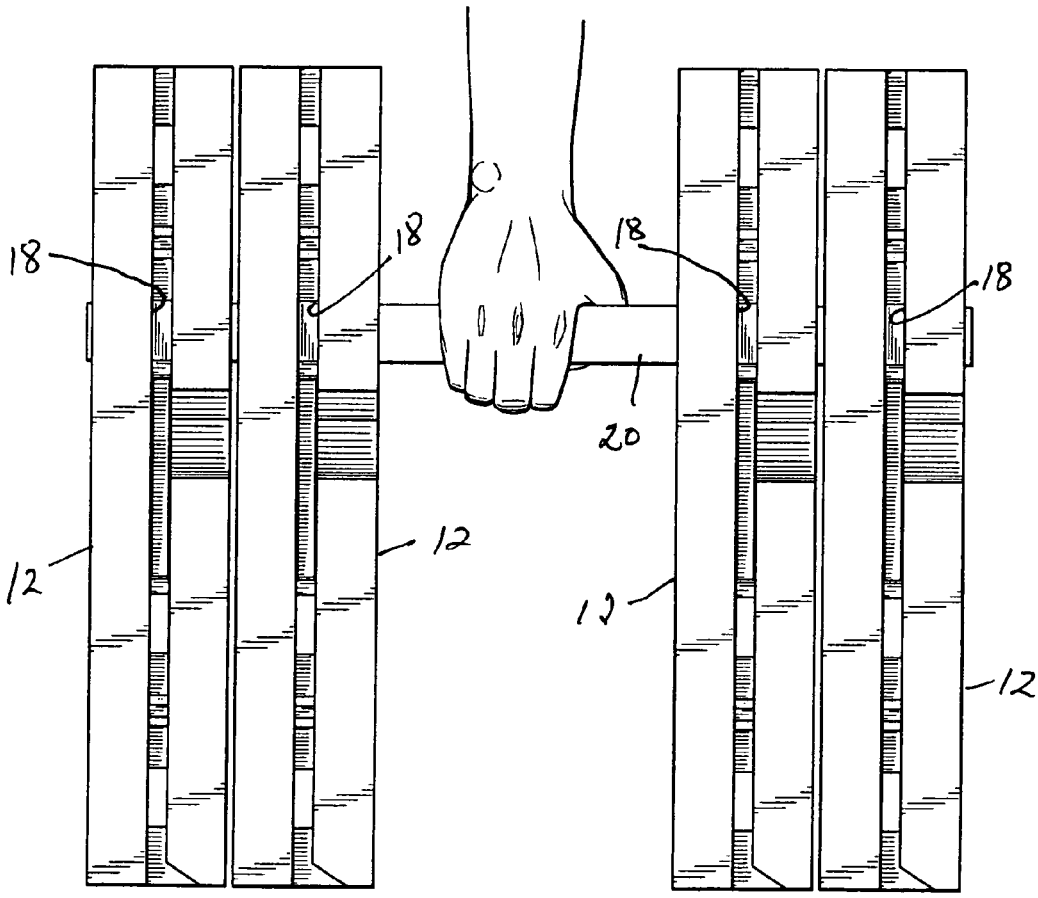
FIG. 11 is perspective view showing the ease of portability of a series of four base units which are interconnected by means of a mounting arm inserted through aligned mounting apertures for ease of portability.

FIG. 11 illustrates the improved portability which is derived from the construction of the base 12 of the present invention. As illustrated in FIG. 11, a series of four base units 12 maybe easily carried by installing two base units 12 to one end of the mounted arm 20, and installing an additional pair of base units 12 to the opposed end of the mounting arm 20. If desired, and as shown in FIG. 11, this method of portability permits a series of four mounting arms 20 to be inserted through aligned mounting apertures of four different base units, such that the entire assembly is easily compactable into a slender configuration for ease of portability and permitting the user to have four base units and four mounting arms carried to the desired location.

FIG. 9 illustrates the method of construction and the relative relationship between the parts of the base 12. It should be pointed out in connection with a view of FIG. 9, that one of the preferred applications for a stand of the present invention is to be used for target shooting. In this respect, it is contemplated that the entire stand assembly would be made from wood which thereby avoids the possibility of bullets ricocheting off of the stand when the stand is employed in a shooting range. As such, all of the parts may be cut to predetermined lengths, so that the stand may be easily assembled assembling the parts as illustrated. It would therefore be appreciated that the first leg 14 is actually composed of two long upper rails 40 and 41 respectively, and two shorter lower rails 42 and 43 respectively. The upper rails 40 and 41 are installed onto the lower shorter rails 42 and 43 respectively, the forward and rearward insets 22 and 24 respectively are formed. Hence, the second leg 16 having a forward section 21 and rearward section 23 will easily nest within the insets 22 and 24 respectively when in the closed position. The outer vertical walls 25 are formed by means of end spacer's 45 and 46 respectively and an inner vertical wall 27 is installed between upper and lower spacers 48 and 49 respectively. It will also be observed that the compressible pad 32 is mounted to the inner wall 27 and the lock plate 34 is then mounted to the opposed surface of the compressible pad 32. Each of the mounting apertures will then be formed as between the inner wall of the end spacers 45 and 46 respectively, and the outer surface of each respective lock plate 34. The entire assembly may be put together using any means desired such as adhesives, screws, or the like. The preferred method of construction if the entire assembly is to be made from wood, would be adhesives since this eliminates any metallic parts and therefore avoids the problem of having any metallic parts which may deteriorate from the result of moisture or other weather conditions.

It will be appreciated that the entire stand 10 may be made from other material such as plastic, composition board, or other metallic as well as metallic materials. As indicated previously, the advantage of non-metallic materials for a stand intended for target shooting at a shooting range avoids the possibility of bullets ricocheting off of the stand.

FIG. 9 also illustrates the assembly of the second leg 16 relative to the first leg 14 in that the second leg is mounted as between a mounting block 51, spacer block 52, and is secured between the two upper rails 40 and 41 respectively. The mounting pin 53 is inserted into an appropriate aperture and spacer in the mounting block 51, (not shown) and passes through a pin aperture 54 in the spacer block 52, and is slid within a pin aperture 56 located in the second leg 16. A pair of opposed rail spacers 58 and 59 are provided in order to secure the lower rails 42 and 43 respectively to the upper rails 40 and 41 respectively.

It will be appreciated from a view of FIGS. 10 and 11 of the drawings that once the stand assembly is in its closed position, and interconnected by means of appropriate vertical arms 20, the entire assembly is sized such that it is no wider than the actual width of the base unit 12. Hence, for portability purposes, the entire unit presents a very compact and easily portable unit. Furthermore, by being constructed in the manner indicated herein, especially with the construction of all wood materials, and interconnected by appropriate adhesives, the unit has no moving parts, and no metallic parts. Hence, moisture and/or other weather conditions will not affect the condition of the unit since there are no metallic parts or moving parts that can deteriorate.

As further illustrated in FIG. 1, as well as FIG. 9, mounting block 51 may be provided with a pair of stake apertures 55 as well as corresponding stake apertures 61 in the spacer block 52. Once the stand is fully erected, appropriate stakes 63 may be inserted through the appropriate stake apertures 55 and 61 respectively, to stake the stand 10 to the ground.

It will be appreciated from the above description, that the stand of the present invention represents an improved construction for a stand assembly, especially adapted for targets for shooting ranges. The entire stand assembly is compact for ease of transport, and virtually moisture and weather resistant. Furthermore, no tools are required for erecting the stand, the only virtually moving part is the second leg 16 which is rotatably mounted relative to the first leg 14. As previously indicated, the construction of the lock means for lockingly engaging the vertical arms virtually eliminates any moving parts, including springs and the like, and hence, virtually eliminates any potential defects from the use of springs or other metallic parts incident to providing a lock means for locking the arms to the base.

While there has been described what is considered to be the preferred embodiment of the invention, it will be understood that various modifications may be made therein and is intended to cover any impended claims all such modifications will fall within the true spirit and scope of the invention.

-continued

| | |
|---|---|
| 10 | stand |
| 12 | base |
| 14 | first leg |
| 15 | first leg width |
| 16 | second leg |
| 17 | second leg width |
| 18 | mounting aperture |
| 20 | vertical arms |
| 21 | forward section of 16 |
| 22 | rearward inset |
| 23 | rearward section of 16 |
| 24 | forward inset |
| 25 | outer vertical wall of 18 |
| 27 | inner vertical wall of 18 |
| 30 | lock means |
| 32 | compressible pad |
| 34 | lock plate |
| 35 | frusto-conical surface of 34 |
| 40 | upper rail of 14 |
| 41 | upper rail of 14 |
| 42 | lower rail of 14 |
| 43 | lower rail of 14 |
| 45 | end spacer |
| 46 | end spacer |
| 48 | upper spacer |
| 49 | lower spacer |
| 51 | mounting block |
| 52 | spacer block |
| 53 | mounting pin |
| 54 | pin aperture |
| 55 | stake aperture |
| 56 | pin aperture of 16 |
| 58 | rail spacer |
| 59 | rail spacer |
| 61 | stake aperture |
| 63 | stake |
| 70 | target |

-continued

What is claimed is:

1. An improved portable stand intended to carry and hold signage therein, comprising a base unit, said base formed by a first leg and a second leg rotationally mounted to said first leg at the approximate mid-point of said first leg said second leg having a forward section and a rearward section said second leg being rotationally movable relative to said first leg into a support position with said forward section rearward of said first leg and said rearward section forward of said first leg, said first leg has a width dimension approximately double the width of said second leg, and said first leg includes a pair of insets positioned diagonally opposed to each other, one inset being forward of the mid point and the other inset being rearward of the mid point thereof, each of said insets having a width approximately equal to the width of said second leg, whereby said second leg may rotationally moved to a closed position with the forward section nested within the rearward inset and the rearward section nested within the forward inset, said first leg provided with at least two spaced apart mounting apertures formed therein, each of said mounting apertures provided with lock means incorporated therein, at least two vertical arms adapted to be mounted into each of said mounting apertures and lockingly engaged therein by said lock means, said vertical arms adapted to carry signage therebetween, whereby said stand may be transported to a desired location and erected by rotating said second leg 90° relative to said first leg to form a support base and mounting said vertical arms into said mounting apertures thereby to carry and display signage mounted between said arms.

2. The portable stand as set forth in claim 1 above, wherein said first leg is provided with a plurality of mounting apertures spaced along the length thereof, each of said mounting apertures provided with lock means incorporated therein, whereby said two vertical arms may be mounted into any two of said plurality of apertures thereby to accommodate signage of larger and smaller dimensions.

3. The portable stand as set forth in claim 2 above, wherein said plurality of mounting apertures are uniformly spaced along the length of said leg.

4. The portable stand as set forth in claim 1 above, wherein said lock means incorporated in each of said mounting apertures is formed by an inner vertical wall and an outer vertical wall, a lock plate forward of said inner wall, and spring means interposed between said inner wall and said lock plate, whereby said vertical arm is mounted by pressing said arm into said mounting aperture and allowing said arm to be captured between said lock plate and said outer vertical wall.

5. The portable stand as set forth in claim 4 above, wherein said spring means comprises a pad of compressible foam material mounted to said inner wall on one side and said lock plate on the opposed side.

6. The portable stand as set forth in claim 5 above, wherein said compressible foam material is rubber.

7. The portable stand as set forth in claim 5 above, wherein said compressible foam material is plastic.

8. The portable stand as set forth in claim 4 above, wherein said lock plate includes an inner surface secured to said spring means and an outer capturing surface adapted to engage and hold said vertical arm in said mounting aperture.

9. The portable stand as set forth in claim 8 above, wherein said outer capturing surface is convex.

10. The portable stand as set forth in claim 8 above, wherein said outer capturing surface is frusto-conical.

11. The portable stand as set forth in claim 4 above, wherein a plurality of base units may be stacked and interconnected by aligning the desired mounting apertures in vertical alignment with one another, and securing said plurality of base units together by inserting at least two vertical arms through said aligned mounting apertures.

12. The portable stand as set forth in claim 1 above, wherein said at least one of said legs is provided with a stake hole formed therein, said stake hole adapted to receive a support stake therethrough to secure said base to an underlying support surface.

* * * * *